United States Patent [19]

Thekdi et al.

[11] 4,214,869

[45] Jul. 29, 1980

[54] FURNACE WITH RADIANT BURNDOWN TUBE

[75] Inventors: Arvind C. Thekdi; Klaus H. Hemsath, both of Sylvania; James G. Conybear, Toledo, all of Ohio; Frank J. Vereecke, Palmyra, Mich.; Steven H. Verhoff, Toledo, Ohio

[73] Assignee: Midland-Ross Corporation, Cleveland, Ohio

[21] Appl. No.: 911,550

[22] Filed: May 31, 1978

[51] Int. Cl.[2] ..... F27B 3/20; F27B 11/08

[52] U.S. Cl. ..... 432/31; 126/91 A; 431/157; 432/72; 432/209

[58] Field of Search ..... 432/31, 72, 209; 126/91 A; 431/157

[56] References Cited

U.S. PATENT DOCUMENTS

| | | | |
|---|---|---|---|
| 2,232,638 | 2/1941 | Schwalbe | 432/209 |
| 2,763,476 | 9/1956 | Ness et al. | 432/72 |
| 2,799,490 | 7/1957 | Rusclano | 432/72 |
| 2,848,207 | 8/1958 | Rusclano | 432/72 |
| 2,860,864 | 11/1958 | Knight | 432/209 |
| 2,873,798 | 2/1959 | Knight | 431/157 X |

*Primary Examiner*—John J. Camby

*Attorney, Agent, or Firm*—Richard A. Negin

[57] ABSTRACT

A radiant burndown tube for furnaces which have a chamber sealable from the ambient atmosphere and in which there is a combustible gas. The burndown tube is divided into three functional areas; the burner leg, the exhaust leg and a tube portion. The tube portion is located within the furnace chamber. There is an inlet where the combustible gas from the furnace chamber is drawn into the burndown tube. The combustible gas is mixed with air and ignited in the tube and the combustion products are exhausted via the exhaust leg. Thus, the heat energy normally lost in the burndown of combustible furnace exhaust gases outside of the furnace is captured and used to provide additional heat to the furnace.

25 Claims, 4 Drawing Figures

FURNACE WITH RADIANT BURNDOWN TUBE

BACKGROUND OF THE INVENTION

This invention is in the field of furnaces; more particularly, the invention relates to radiant tubes used to heat furnaces.

Furnaces which use radiant tube heaters as a total or partial heat source are known in the art and are in common use. Radiant tubes, as are known, have sources of air and fuel external to the furnace. The environment within the tube is independent of the atmosphere within the furnace with regard to certain properties, particularly composition and pressure. The air and fuel are mixed and burned uniformly within the radiant tube. Thereby the radiant tube provides a source of heat which radiates relatively uniformly along the length of the tube. By careful furnace design and location of such radiant tubes, a furnace can be heated to suit a particular process need.

Various furnaces in which radiant tubes are or can be used have atmospheres that contain combustible gases. Many furnace applications have high hydrogen and carbon mon-oxide low BTU or low combustion atmospheres to facilitate reducing, carburizing or similar process conditions. The atmospheres, therefore, have a significant heating value that can approach the heating value of a low BTU gas (150 BTU/cubic ft). Normally, these atmospheres are exhausted from the furnace and burned off in the environment outside of the furnace. If the energy in such a low BTU atmosphere gas could be saved, the heat savings could be substantial.

A typical example is the endothermic gas that acts as a carrier gas in a carburizing furnace. Normally, such gas is burned off outside the furnace in the environment after use. In a typical continuous carburizing furnace at least 2,000 standard cubic feet per hour (scfh) of low BTU endothermic carrier gas is used. The available heat which could be obtained from this gas could amount to over 250,000 BTU/hr. It would be desireable to provide a means to utilize the energy available in furnace atmospheres.

In the past attempts to capture the energy of the combustible gas in the furnace chamber resulted in the need for drastic structural changes in furnace design. One such example is U.S. Pat. No. 2,848,207 by F. A. Rusciano. In this patent combustible gases from the combustion chamber are vented to secondary heating chambers built into the floor of the furnace. This patent requires major structural changes in the furnace as well as a complicated venting system. The present invention allows the capturing of the energy in the combustible gas in the furnace chamber for direct use in the furnace chamber without major structural modifications in the furnace and without a cumbersome venting system.

A clearer understanding of some of the advances of the present invention over the state of the art will be noted by a review of radiant tube heaters. Of particular interest are U.S. Pat. Nos. 2,860,864; 2,764,145; and 2,873,798.

Tube materials are generally made of nickel-chrome alloys which must be able to resist the heat as well as carbon attack. Flame temperatures are higher than the temperatures which the tube can withstand for reasonable lengths of time. To overcome this problem and accommodate a general goal of uniform burning along the length of the tube, radiant burners introduce fuel or a fuel-air premix is fed into the tube along the longitudinal center of the tube. Combustion air is introduced between the fuel or fuel-air premix and the tube wall thereby providing a barrier of air between the actual flame site and the tube wall. This is of particular importance near the entrance of the tube where hot spots can be troublesome.

SUMMARY OF THE INVENTION

The present invention is an improvement in furnaces having atmospheres containing combustible gases within a sealed furnace chamber. Typical furnaces having combustible atmospheres are carburizing furnaces, although the present invention can be used in a variety of furnace applications where there is a combustible gas atmosphere within the furnace chamber, and is not limited to carburizing furnaces. The furnace is provided with a burndown tube composed of a metal alloy such as nickel-chrome alloy which is heat resistant and resistant of carbon attack. The burndown tube comprises an exhaust means through which the products of combustion within the tube are exhausted outside of the furnace and an inlet through which the combustible atmospheric gas from within the chamber is drawn into the tube. Means are supplied for mixing the combustible gas in the tube with combustion air and for igniting the mixture so as to achieve uniform burning with a relatively low temperature spread along the length of the tube. Therefore, the heat energy normally lost in the burndown of combustible furnace exhaust gases outside of the furnace is captured and used to provide additional heat to the furnace.

It is the general object of the present invention to provide a furnace with at least one burndown tube which burns the combustible gas atmosphere within the chamber of the furnace. It is another object of the present invention to provide the burndown tube with an eductor, jet pump or other suitable suction device at the outlet to help draw the combustible atmosphere gas into the burner inlet. It is a further object of the present invention to provide an air nozzle at the inlet of the tube which will achieve the required entrainment of the combustible gas in the combustion air within the tube for controlling mixing, uniform burning and a relatively low temperature spread along the length of the tube. Another object is to provide a burndown tube wherein combustion air is fed into the tube along the longitudinal center of the tube and combustible gas is fed between the combustion air and the wall of the tube and where there is controlled mixing, uniform burning and no hot spots along the length of the tube. Yet another object of the present invention is to provide means to supply combustion air to the burndown tube so that no combustion air enters the chamber of the furnace.

A further general object of the present invention is to provide a method for operation of a furnace containing a combustible gas atmosphere whereby the combustible gas is continually removed from the furnace chamber into a burndown tube within the furnace chamber where it is mixed with combustion air and burned, supplying heat to the furnace chamber and the spent combustion products are then exhausted out of the furnace. Another object of the present invention is to provide a method for operation of a furnace containing combustible gas, where the combustible gas from the furnace and the combustion air are stoichiometrically mixed in the burndown tube. A further object of the present invention is to provide a method for operation of a furnace containing a combustible gas, where the combustible gas is entrained in the combustion air within the burndown tube for uniform burning and a relatively low temperature spread along the length of the tube.

It is the object of this invention to obtain one or more of the objects set forth above. These and other objects and advantages of this invention will become apparent to those skilled in the art from the following specification and claims, reference being had to the attached drawings.

DESCRIPTION OF THE PREFERRED EMBODIMENTS

Structure

Figure 1:
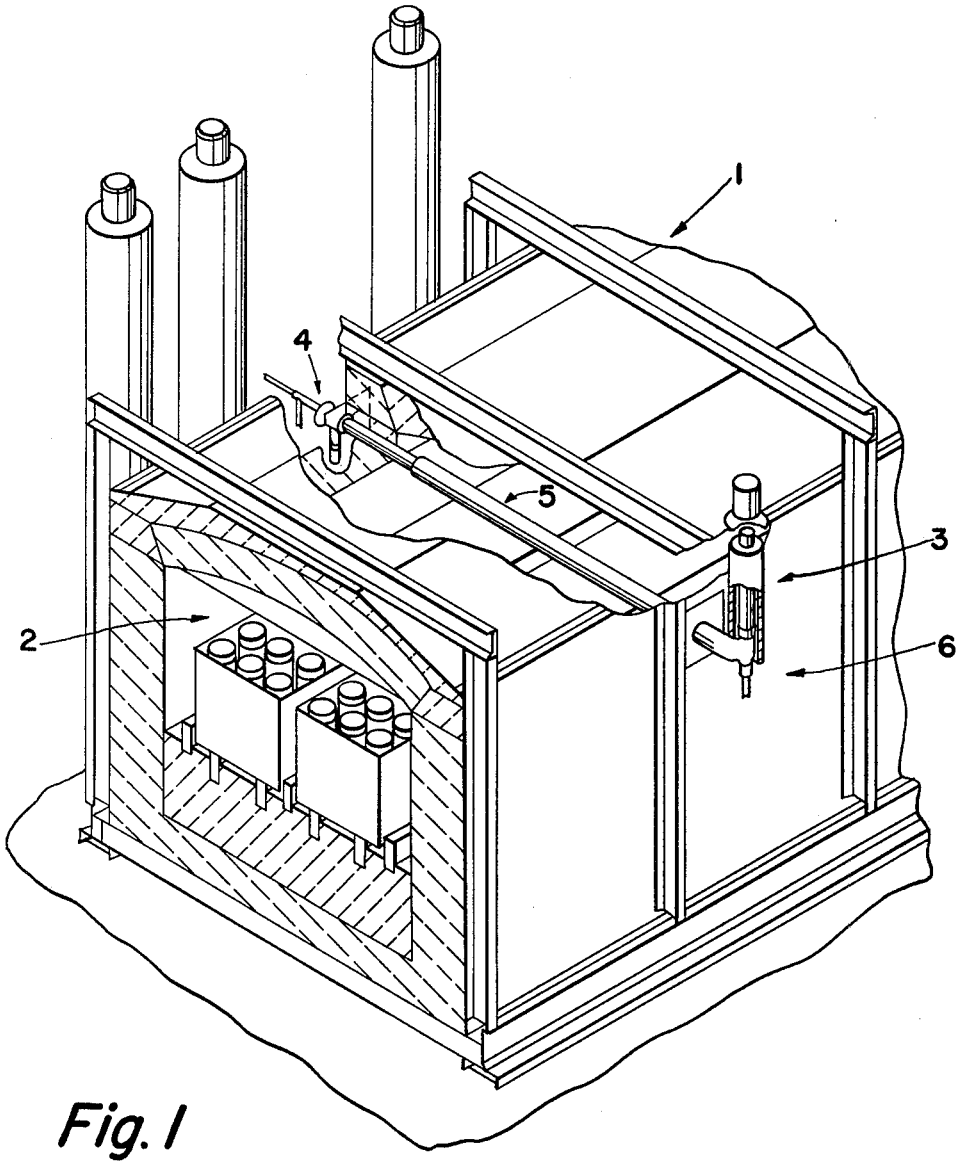
FIG. 1 is a perspective view of a typical furnace with the burndown tube of the present invention. This furnace is a typical carburizing furnace.
Figure 2:
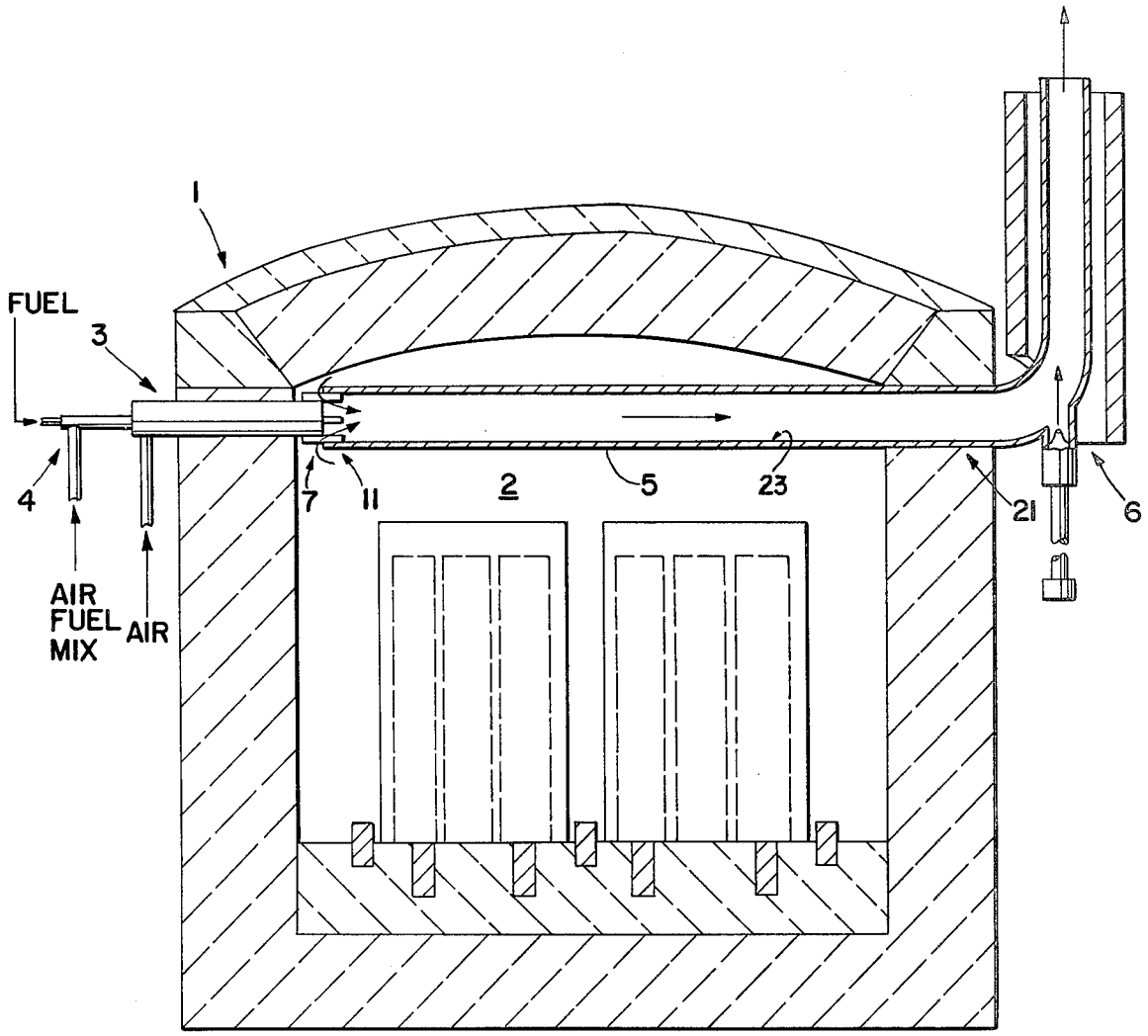
FIG. 2 is a sectional view of FIG. 1 through the burndown tube.
Figure 3:
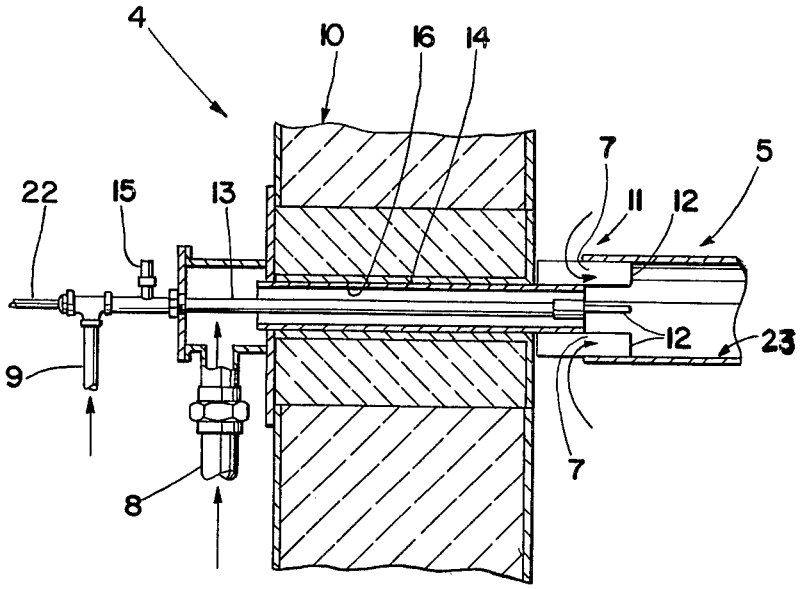
FIG. 3 is an enlarged sectional view of the burner leg of the burndown tube.
Figure 4:
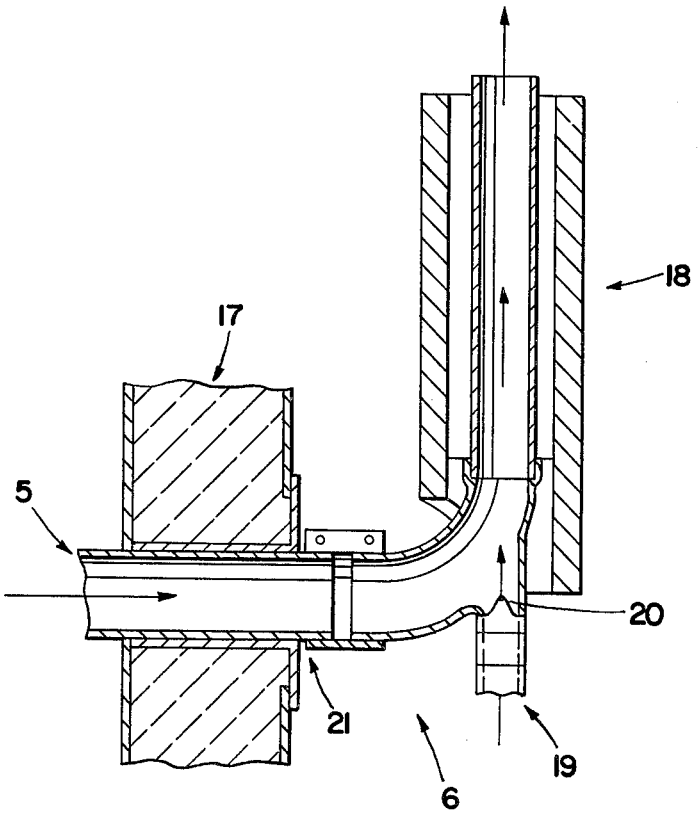
FIG. 4 is an enlarged sectional view of the exhaust leg of the burndown tube.

The present invention will be understood by those skilled in the art by reference to FIG. 1, which is a view in perspective of one embodiment of the present invention, and FIGS. 2, 3 and 4 which are sectional views of the present invention and portions of the present invention shown in FIG. 1. FIG. 1 shows a carburizing furnace 1. During typical operation of such a carburizing furnace, a furnace chamber 2 contains a combustible gas, usually an endothermic carrier gas which contains carburizing gas such as methane or natural gas. Although a carburizing furnace 1 is shown and used in this description, the invention should not be limited to carburizing furnaces but can be any furnace with a combustible gas atmosphere in the heating chamber. A carburizing furnace illustrates that the present invention can be used with a low heating value combustible gas such as the endothermic carrier gas used in carburization.

FIG. 2 shows the burndown tube 3 located within the furnace 1. Although the burndown tube 3 is shown placed along the ceiling of the furnace, the present invention is not so limited. The burndown tube can be at any location and in any orientation within the heating chamber 2 to meet the heating requirements of the furnace and be practical with regard to the overall furnace design. The burndown tube 3 of FIGS. 1 and 2 is shown as a straight tube. However, the present invention is not so limited. In addition to straight tubes, a U-tube, or other suitable burndown tube configurations can be used.

The burndown tube is divided into three functional areas; the burner leg 4, the exhaust leg 6 and the tube portion 5. The tube portion 5 of the burndown tube must be hollow and composed of a suitable metal alloy such as a nickel-chrome alloy which is heat resistant and resistant to carbon attack. The tube portion 5 is located within the furnace chamber 2 and has a burner end 11 and an exhaust end 21. The burner end 11 is adjacent to the furnace wall 10, as shown in FIG. 3.

The burner leg 4 can be described with reference to FIG. 3. The burner leg 4 comprises a hollow conduit 14 which extends through the furnace wall 10 of the furnace chamber 2 to adjacent burner end 11 of the burndown tube 3. The conduit 14 is maintained in a spaced relation along the centerline of the tube portion 5 of the burndown tube 3 by a plurality of spacer bars 12.

In the burner leg there is an ignition means which comprises a fuel and air premix line 9 which carries any suitable fuel and air mixture to a pilot pipe 13 which extends longitudinally through the conduit 14. The fuel and air mixture can be ignited by a pilot 15 or any other appropriate means that is in communication with the pilot pipe 13. Combustion air is brought to the burndown tube 3 from an air line 8. The combustion air passes from the air line 8 to the tube portion 5 through an annular passageway 16 which is formed between the inner pilot pipe 13 and the outer surrounding hollow conduit 14; this annular passageway 16 from through which the air enters the tube portion of the tube portion can also be called the air nozzle. Although the air nozzle configuration of the present invention can vary in design, the preferred air nozzle for use in the present invention is the type known in the air as an annular swirl air nozzle. The annular swirl air nozzle provides the proper air flow patterns for optimum entrainment and mixing of combustible gas from the furnace chamber to assure uniform heat radiation from the burndown tube and a relatively low temperature spread.

A fuel pipe 22 through which fuel is transported to the tube portion 5 can be included in the present invention. The fuel pipe 22 extends longitudinally through pilot pipe 13, within the burner leg 4. Fuel can be introduced into the tube portion 5 of the burndown tube 3, as desired, to supplement the combustion gas from the furnace chamber 2, to be used as the sole source of fuel or no fuel at all need be introduced into the tube portion 5 from the fuel pipe 22.

The space between the burner end 11 and the conduit 14 and between the spacer bars 12 determines the area of an annular inlet 7. The inlet area can be increased or decreased, as desired. One method of varying the inlet area is by the use of more or less spacer bars. The annular inlet 7 is an opening in the burndown tube 3 within the furnace chamber 2 whereby the combustible gas within the furnace chamber 2 can enter the burndown tube 3. Although the inlet of the preferred embodiment is specifically defined as noted, a suitable inlet in the furnace chamber 2 satisfying the design criteria noted below will suffice. For example, the inlet can be openings in the tube portion 5 near the burner leg 4 of the burndown tube.

The design of the annular inlet 7 in cooperation with the design of the air nozzle results in the introduction of air into the burner end of the tube along the longitudinal center of the tube portion 5 and the combustible gas from the furnace chamber 2 being fed between the tube wall 23 and the combustion air stream. Therefore, the radiant burndown tube of the present invention, resulting in a uniform air and fuel mixture and uniform heat radiation with a low temperature spread along the length of the tube, has a fuel and air feed design not shown in previously known radiant tube burners. The present invention should not be limited to exact design of the present embodiment of the annular inlet. Particularly with low combustion gases the fuel can be fed between the combustion air and the tube wall, whether the fuel is fed from within the furnace chamber 2 atmosphere or vented or piped to the burner leg 4 from within the furnace chamber by suitable means known in the art.

The exhaust leg 6 can be described with reference to FIG. 4. The exhaust leg 6 which is connected to the exhaust end of the tube portion is a means for exhausting the contents of the tube portion. The exhaust end 21 of the tube portion 5 can exit through the furnace wall 17 where it is connected to a thermally insulated stack 18, through which the hot products of combustion from the burndown tube 3 are exhausted. Between the tube portion 5 and the insulated stack 18 can be interposed a means for drawing the contents of the tube portion 5 to the exhaust means such as a jet pump 19 which is preferably connected to the tube portion 5 after its exit through the furnace wall 17. Air or any other suitable gas can be forced through the nozzle 20 of the jet pump 19 which directs a stream of high velocity air into the insulated stack 18 effectively causing a pressure drop within the stack 18 so that there is a pressure difference between the gases in the tube portion 5 and the stack 18. This pressure difference transfers back to the inlet leg 4 and can thereby affect the amount of combustible gas from the furnace chamber 2 which is being drawn in through the annular inlet 17. Thus, the exhaust leg 6 comprises means for drawing combustible gas from the furnace chamber 2 through the burndown tube 3 and means for exhausting from the furnace, the hot products of combustion formed within the burndown tube.

The air source to jet pump 19 can be the same as the air source for the combustion air and to the air nozzle. This design provides an additional measure of safety. For when the air to the jet pump 19 is cut off due to a stoppage at the air source, air to the air nozzle will also be cut off. When the jet pump 19 is not operating the pressure drop across the burndown tube decreases and the combustion air that would otherwise come from the air nozzle to the tube portion 5 could escape into the furnace chamber 2 and result in undesired combustion.

An alternate embodiment of the exhaust leg 6 which can provide the means for drawing the contents of the tube portion 5 which in turn draws gases from furnace chamber 2 is an exhaust fan which can be connected to the exhaust leg 6 preferably at stack 18.

Operation and Design

In general, the method of operation of the burndown tube of the present invention comprises: introducing air into the tube portion; drawing the combustible gas into the inlet; mixing the air and combustible gas within the tube portion; igniting the mixture; and exhausting the contents of the tube portion.

The operation of the preferred embodiment of the present invention begins with the jet pump 19 directing a stream of high velocity air into the stack 18. This draws combustible gas from the furnace chamber 2 into the annular inlet 7 in the burndown tube 3. Fuel enters through the fuel line 9 and combustion air enters from a suitable air source, preferably through the air nozzle. The combustion air passing from the air nozzle past the annular inlet 7 also draws combustible gas from the furnace chamber 2. Pilot 15 or suitable means will ignite the fuel and air mixture and this, in turn, will ignite the air and combustible gas from the furnace chamber 2 which are in the tube portion 5. The ignition of the air and combustion gas in the tube portion 5 of the burndown tube is generally self-perpetuating so that the fuel from the fuel line 8 can be cut off. In actual practice the pilot remains on for safety reasons. The burned gas from the burndown tube 3 exhausts through the exhaust means such as the stack 18.

During normal operation, the use of the jet pump 19 directing a stream of high velocity air into the stack 18 results in a suction in the tube portion 5. This suction transfers back to the annular inlet 7. The pressure in the burndown tube 3 at the annular inlet 7 will be lower than the pressure of the atmosphere in the furnace chamber 2. The combustible gas atmosphere in the furnace chamber 2 will, therefore, enter the burndown tube 3 at the annular inlet 7.

The air nozzle must be designed so that the flow rate of combustion air can be controlled in a suitable range and to permit combination with combustible gas from the furnace chamber in stoichiometric proportions for complete combustion. The pressure drop of the air stream across the air nozzle in the burner leg 4 and the spiral velocity of the combustion air must be controlled so that there is proper entrainment of the combustible gas in the combustion air within the burndown tube for burning along the length of the tube portion with a relatively low temperature spread.

The annular inlet 7 must be designed with regard to inlet area so as to cooperate with the air nozzle design to achieve a stoichiometric combustible gas to combustion air ratio and uniform mixing desired in the present invention. Finally, the jet pump 19 can easily be sized to cooperate with the design of the air nozzle and annular inlet 7 so that the amount of combustbile gas taken from the furnace chamber can be controlled with the normal range of operation of the burndown tube 3 by controlling the flow rate of air through the jet pump.

The fuel to air ratio can be controlled by the flow rate of the combustion air and combustible gas entering the tube portion 5. Stoichiometric amounts of combustion air and combustible gas can be related back to the heat value of the combustion gas. With a given heat value the proper stoichiometric reaction ratio can be determined. The air to fuel ratio can be changed to other than the stoichiometric ratio depending on measured furnace and burndown tube temperatures or to control burndown tube temperature and thereby control furnace temperature. In the preferred design of the burndown tube of the present invention, the various parts of the burndown tube should be sized for a reasonably constant combustible gas composition at a measured flow rate during operation.

The use of the jet pump adds an extra dimension to control and limit the operation of the present invention. In its most basic form a jet pump is not necessary. One important reason for its use is that it acts like a booster to help pull combustion gas from the furnace chamber through the annular inlet 7. For although the stream of air rushing past the inlet will pull the combustible gas into the tube portion 5, there are mass flow limits due to friction in the burner. To increase the mass flow beyond these limits the jet pump or other suitable suction means is used.

The general operation of another embodiment of the present invention is the operation of the invention without a jet pump. In this embodiment fuel enters through the fuel line 9 and combustion air enters through the air nozzle. Pilot 15 or suitable ignition means will ignite the fuel and air mixture. The air stream moving from the air nozzle to the tube portion 5 of the burndown tube will result in a pressure decrease in the neighborhood of the air stream. This pressure decrease in the area of the annular inlet 7 can draw combustible gas from the furnace chamber 2 into the burndown tube 3. The ignition of the air and combustion gas in the tube portion 5 of the burndown tube is generally self-perpetuating so that the fuel from fuel line 9 can be cut off. The burned gas from the burndown tube 3 exhausts through the stack 18, which can be connected to an exhaust fan.

The present invention can be used in a new or retrofitted electric, gas or oil fired furnace. The air supply can be part of the total burndown tube system of a furnace and separated from the other air requirements of the furnace. The air supply system has incorporated in it the required safety equipment to insure against air infiltrating into the furnace as combustible furnace atmosphere infiltrates into the air lines.

Thus, a means and method for utilizing the energy in the combustible gas of the furnace heating chamber atmosphere before the combustible gas is exhausted from the furnace.

Modifications, changes, and improvements to the preferred form of the invention herein disclosed, described and illustrated, may occur to those skilled in the art who come to understand the principles and precepts thereof. Accordingly, the scope of the invention set forth herein, but rather should be limited by the advance of which the invention has promoted the art.

What is claimed is:

1. A furnace which comprises:

a sealed furnace chamber containing a combustible gas;

a radiant burndown tube which further comprises;

a tube portion located within the furnace chamber, the tube portion having a burner end and an exhaust end, an inlet to the tube portion from the furnace chamber near the burner end of the tube portion through which combustible furnace gas is fed, a means for exhausting the contents of the tube portion connected to the exhaust end of the tube portion, a burner leg connected to the burner end of the tube portion which further comprises, an ignition means, and an air nozzle directed to feed combustion air from the burner leg into the tube portion so as to achieve the entrainment of combustible furnace gas in the air within the tube portion for uniform burning and a relatively low temperature spread along the length of the tube portion.

2. The furnace as recited in claim 1 which further comprises:

a means connected to the exhaust end of the tube portion for controllably drawing the contents of the tube portion to the exhaust means and combustible gas from the furnace chamber into the tube portion.

3. The furnace as recited in claim 2 wherein the means connected to the exhaust end of the tube for controllably drawing the contents of the tube portion and the combustible gas from the furnace chamber into the tube portion is a jet pump disposed between the exhaust end and the exhaust means.

4. The furnace as recited in claim 1 wherein the air nozzle used is an annular swirl air nozzle.

5. The furnace as recited in claim 4 wherein the ignition means comprises:

a pilot pipe through which fuel is brought to the burner end of the tube portion; and a pilot means to ignite the fuel brought by the pilot pipe.

6. The furnace as recited in claim 5 wherein the burner leg comprises:

a hollow conduit which extends into the furnace chamber and is located along the centerline of the tube portion adjacent to the burner end of the tube portion;

the pilot pipe extending longitudinally through the hollow conduit; and a fuel pipe extending longitudinally through the pilot pipe.

7. The furnace as recited in claim 1 wherein the tube portion is a straight pipe.

8. The furnace as recited in claim 1 wherein the tube portion is U-shaped.

9. The furnace as recited in claim 1 wherein the tube portion has inlet openings near the burner end.

10. The furnace as recited in claim 1 which further comprises: spacer bars which connect the air nozzle and the burner end of the tube portion; and where the inlet is the opening defining between the burner end of the tube portion and the air nozzle and between the spacer bars.

11. The furnace as recited in claim 1 wherein the exhaust means is a stack.

12. An improved furnace of the type having a sealed furnace chamber containing a combustible gas, wherein the improvement comprises:

a radiant burndown tube which further comprises;

a tube portion located within the furnace chamber, the tube portion having a burner end and an exhaust end, an inlet to the tube portion from the furnace chamber near the burner end of the tube portion through which combustible furnace gas is fed, a means for exhausting the contents of the tube portion connected to the exhaust end of the tube portion, a burner leg connected to the burner end of the tube portion which further comprises, an ignition means, and an air nozzle directed to feed combustion air from the burner leg into the tube portion so as to achieve the entrainment of combustible furnace gas in the air within the tube portion for uniform burning and a relatively low temperature spread along the length of the tube portion.

13. The improved furnace as recited in claim 12 wherein the radiant burndown tube is installed within a new furnace.

14. The improved furnace as recited in claim 12 wherein the radiant burndown tube is retrofitted into an existing furnace.

15. A furnace which comprises:

a sealed furnace chamber containing a combustible gas;

a radiant burndown tube which further comprises;

a tube portion located within the furnace chamber, the tube portion having a burner end and an exhaust end, an inlet to the tube portion from the furnace chamber, located near the burner end of the tube portion, through which combustible furnace gas is fed, a means for exhausting the contents of the tube portion connected to the exhaust end of the tube portion, a jet pump disposed between the exhaust end of the tube portion and the exhaust means for controllably drawing the contents of the tube portion to the exhaust means and combustible gas from the furnace chamber into the tube portion, a burner leg connected to the burner end of the tube portion which further comprises, an ignition means, and an annular swirl air nozzle directed to feed combustion air from the burner leg into the tube portion so as to achieve the entrainment of combustible furnace gas in the combustion air within the tube portion for uniform burning and a relatively low temperature spread along the length of the tube portion.

16. The furnace as recited in claim 15 which further comprises: spacer bars which connect the burner leg and the burner end of the tube portion; and where the inlet is the opening defined between the burner end of the tube portion and the burner leg and between the spacer bars.

17. A method of burning combustible gas atmosphere in a furnace having at least one radiant burndown tube, the furnace having a furnace wall, a sealed furnace chamber, a conduit through the furnace wall, and the radiant burndown tube having a tube portion within the furnace chamber, the tube portion having a burner end and an exhaust end, an exhaust means connected to the exhaust end, a burner leg connected to the burner end, the burner leg having an ignition means and an air nozzle, comprising the steps of:

locating the burner end so that there is an annular space inlet between the burner end and the conduit;

introducing air from the air nozzle into the burner end of the tube portion of the radiant burndown tube;

drawing the combustible gas from the furnace chamber through the inlet into the tube portion;

mixing the air and the combustible gas within the tube portion;

igniting the air and combustible gas mixture within the tube portion;

controlling the flow of air through the air nozzle to insure entrainment of the combustible gas in the air within the tube portion for uniform burning with a relatively low temperature spread along the length of the tube portion;

exhausting the contents of the tube portion to an exhaust means.

18. The method of burning the combustible gas atmosphere in a furnace as recited in claim 17 wherein the air and the combustion gas are mixed in stoichiometric proportions for complete combustion.

19. The method of burning the combustible gas atmosphere in a furnace as recited in claim 17, wherein the step of controlling the flow of air through the air nozzle to insure entrainment of the combustible gas in the air within the tube portion further comprises the step of controlling the pressure drop of the air stream across the air nozzle.

20. The method of burning the combustible gas atmosphere in a furnace as recited in claim 19 wherein a jet pump connected to the exhaust end of the tube controllably draws the combustible gas into the inlet of the burndown tube.

21. The method of burning the combustible gas atmosphere in a furnace as recited in claim 20 wherein the air is introduced into the tube portion of the burndown tube through an annular swirl nozzle.

22. The method of burning the combustible gas atmosphere in a furnace as recited in claim 19 wherein the air nozzle is an annular swirl nozzle, further comprising the steps of: controlling the pressure drop of the air stream across the annular swirl nozzle; and controlling the spiral velocity of the air stream whereby there is proper entrainment of the combustible gas in the air within the tube portion of the burndown tube for uniform burning along the length of the tube portion with a relatively low temperature spread along the length of the tube.

23. The method of burning the combustible gas atmosphere in a furnace as recited in claim 22 further comprising: maintaining a reasonably constant combustible gas atmosphere in the furnace chamber; controlling the air flow rate through the annular swirl nozzle; and controlling the combustible gas flow rate through the inlet whereby the air and the combustible gas combine in stoichiometric proportions for complete combustion.

24. The method of burning the combustible gas atmosphere as recited in claim 17 further comprising the step of varying the area of annular space inlet.

25. The method of burning the combustible gas atmosphere as recited in claim 24 where spacer bars between the conduit and the tube are used to vary the area of the annular space inlet.

* * * * *